US009944372B1

(12) United States Patent
Stahl

(10) Patent No.: US 9,944,372 B1
(45) Date of Patent: Apr. 17, 2018

(54) EFFICIENT REVERSE THRUSTING MODULAR PROPELLER

(71) Applicant: Bradford C. Stahl, Jackson, CA (US)

(72) Inventor: Bradford C. Stahl, Jackson, CA (US)

( * ) Notice: Subject to any disclaimer, the term of this patent is extended or adjusted under 35 U.S.C. 154(b) by 252 days.

(21) Appl. No.: 14/756,550

(22) Filed: Sep. 16, 2015

(51) Int. Cl.

| | |
|---|---|
| ***B63H 1/26*** | (2006.01) |
| ***B63H 1/20*** | (2006.01) |
| ***F04D 29/22*** | (2006.01) |
| ***F04D 29/66*** | (2006.01) |

(52) U.S. Cl.
CPC ..... *B63H 1/26* (2013.01); *B63H 1/20* (2013.01); *F04D 29/2283* (2013.01); *F04D 29/669* (2013.01)

(58) Field of Classification Search
CPC ..... F04D 29/007; F04D 29/18; F04D 29/32; F04D 29/38; F04D 29/384; F04D 29/2283; F04D 29/66; F04D 29/669; B63H 1/14; B63H 1/20; B63H 1/26
See application file for complete search history.

(56) References Cited

U.S. PATENT DOCUMENTS

| | | | | |
|---|---|---|---|---|
| 4,930,987 | A | 6/1990 | Stahl | |
| 5,158,434 | A * | 10/1992 | Weetman | B01F 7/00341 366/330.5 |
| 6,164,919 | A * | 12/2000 | Vanmoor | B63H 1/26 416/242 |
| 6,699,016 | B1 | 3/2004 | Dean | |
| 7,056,092 | B2 * | 6/2006 | Stahl | B63H 1/14 416/129 |
| 7,637,722 | B1 * | 12/2009 | Koepsel | B63H 1/14 416/238 |
| 8,636,469 | B2 | 1/2014 | Powers | |

* cited by examiner

*Primary Examiner* — Igor Kershteyn
*Assistant Examiner* — Brian P Wolcott
(74) *Attorney, Agent, or Firm* — Robert Charles Hill

(57) ABSTRACT

An efficient reverse-thrusting modular propeller combines a center hub and a set of identical and replaceable blades. Each such blade has a radially and laterally symmetrical hydrofoil cross-section but disposed along a full wave (360°) sinusoidal mean camber line. The blades all feature a very strong thicker symmetric hydrofoil cross-section at the propeller root which widens with a longer sinusoidal mean camber line wavelength, and thins in amplitude moving outward, and then the blades narrow again in shorter wavelength and thin more in diminishing amplitudes progressing toward the distal tip. Localized cupping on the leading or trailing edges is ruled-out as undesirable and counterproductive.

11 Claims, 5 Drawing Sheets

200
blade-A
201
blade-B
202
blade-C
203
fin-A
205
fin-B
206
fin-C
207
hub
204
root-A
208
root-B
209
root-C
210
no edge "cupping"
no edge "cupping"
no edge "cupping"
no edge "cupping"
no edge "cupping"
no edge "cupping"
max
thickens
0
root width
narrows
widens
0
radius station-A
radius station-B
radius station-C
maximum constant radius width

EFFICIENT REVERSE THRUSTING MODULAR PROPELLER

BACKGROUND OF THE INVENTION

Field of the Invention

The present invention relates to water propellers, and more particularly to modular propellers used on boats that provide near equal reverse thrust and forward thrust.

Description of Related Art

Sterndrive and outboard props do not work very well in reverse. The reason is that conventional props have been designed to provide optimum thrust going forward. But reverse thrust is the principal way boat skippers use to slow down and stop their boats quickly, especial when moving too fast or when the boat is very heavy and inertia continues to propel the boat after power is cut.

Heavy, high windage houseboats, pontoon boats, and barges are especially challenged in slowing down because going into reverse is about the only way to stop a boat faster than just allowing it to drift to a stop. That was the big advantage in big paddlewheel steamboats that were in common usage in the 19th Century Mississippi riverboats.

A few patented devices have been marketed commercially that added ridges on the aft surfaces of a prop blade to help to improve reverse thrust. The "solution" was to streamline the cupping by fairing it into the underside of the leading edge. This is said to create an aft tapered cup in the top of the trailing edge. These two cups on opposite sides of the blade are supposed to "grip" the water for better control in both directions. On the forward side of the blade, a parallel ridge is formed 8% to 12% back from the edge. The ridge profile rises 3/16" above the blade surface, in effect, creating a "double-cup". This is claimed to be the single most important element in improving the reverse thrust. The "leading" edge (in forward direction) of each blade is thus a bit thicker than conventional props, with the desirable side-effect of enhancing durability. One Inventor, Charles S. Powers, claims only a slight loss of forward speed. Today, all modern blades incorporate localized cupping on the (forward direction) trailing edges of the blades.

Such now conventional cupping does not change the basic hydrofoil shape looked at in cross-section, it is no more than a localized bending of the leading or trailing edges up or down. Some just add a "special feature" to one edge of their propellers. Conventional propellers all use a "standard" propeller hydrofoil shape. Such do not change the "mean camber line" except maybe very locally at the leading and trailing edges.

A modular plastic marine propeller and hub assembly is described by the present inventor, Brad Stahl, in U.S. Pat. No. 4,930,987, issued Jun. 5, 1990. Three plug-in blade "roots" are slipped into an interlocking matching hub between front and rear end caps. The main parts are made of injection-molded high-strength fiber-reinforced plastic but the design is not limited to just composite materials. The costs of manufacturing such propellers are significantly less than conventional metal propellers. Nine to eighteen inch diameter three-blade propellers intended for 9-350 horsepower motors are typical.

SUMMARY OF THE INVENTION

Briefly, an efficient reverse-thrusting modular propeller embodiment of the present invention comprises a center hub and a set of three replaceable blades. Each such blade has a symmetric hydrofoil cross-section but disposed along a full wave (360°) sinusoidal mean camber line. The identical blades all have a thicker symmetric hydrofoil cross-section at the propeller root which widens with a longer wavelength and thins with a diminishing amplitude moving outward, and then the blades narrow again in shorter wavelength and thin more in lessening amplitudes progressing toward the distal tip. Localized cupping on the leading or trailing edges is ruled out as undesirable and counterproductive.

The above and still further objects, features, and advantages of the present invention will become apparent upon consideration of the following detailed description of specific embodiments thereof, especially when taken in conjunction with the accompanying drawings.

DETAILED DESCRIPTION OF THE INVENTION

Efficient reverse-thrusting modular propeller embodiments of the present invention comprise a set of identical, replaceable blades with tapered root bases that exactly fit into corresponding interlocking and tapered slots in a center hub. The center hub includes an integrated front cap and a solid aluminum core encapsulated with fiber-reinforced composite polymer resin. The blades together are seized in place between fore and aft caps. Each blade at every radius station has a symmetric hydrofoil cross-section disposed along a substantially sinusoidal mean camber line. The blades begin at their roots with thicker symmetric hydrofoil cross-sections that then widen and thin at greater radii outward, and then narrows but continues thinning more as the distal tip is approached. No localized cupping on the leading or trailing edges is desirable or productive.

Figure 1:
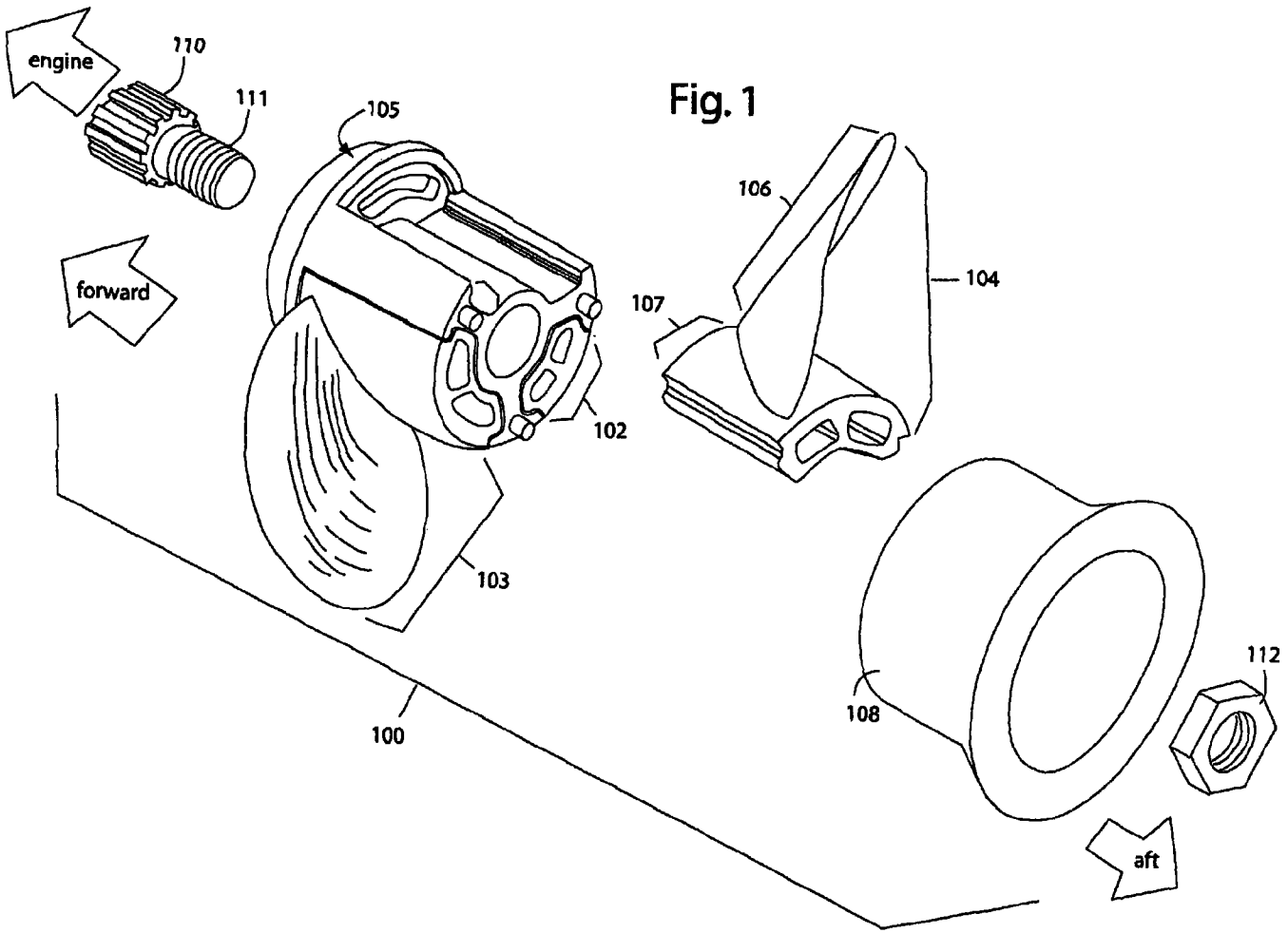
FIG. 1 is an exploded assembly side view of an efficient reverse-thrusting modular propeller embodiment of the present invention, in this example, as used on inboard/outboard, outboard boat motors and ducted propulsion devices in a one piece or modular configuration. The propeller is comprised of interlocking replaceable propeller blades seized into identical matching slots in a center hub to form a familiar pedal-curve in profile; The number of blades on a single propeller may range from as few as two to eight or more.

The mean camber line of the hydrofoil shapes remain the same from the root to the tip as the thickness decreases. A symmetrical hydrofoil is superimposed onto a 360° sinusoidal shape. In embodiments of the present invention, the symmetrical hydrofoil varies from about a 3% thickness-to-chord-ratio to about a 20% thickness-to-chord-ratio. FIG. 1 picks the 75% radius station where such ratio is about 8% (the thickness of the hydrofoil is 8% of the chord length). So if the chord length were ten inches, and it was 10% thick, the propeller's fins would be one inch thick at maximum in the middle.

The upper and lower surface contours (the difference being the thickness) can be expressed mathematically, for example at the 75% radius station:

$$Y=0.575x^3-0.966x^2+0.393x+0.008; \quad \text{upper surface:}$$

$$Y=0.575x^3-0.759x^2+0.185x-0.010; \text{ and} \quad \text{lower surface:}$$

$$Y=A \sin x, \text{ where } 0.02 \leq A \leq 0.08. \quad \text{mean camber line:}$$

FIG. 1 illustrates an efficient reverse-thrusting modular propeller embodiment of the present invention, referred to herein by the general reference numeral 100. Propeller 100, in this example, can be used on outboard boat motors and Ducted propulsion devices and comprises interlocking replaceable propeller blades (A, B, C) 102, 103, 104 locked into identical matching slots in a center hub 105. These form a familiar pedal-curve in profile.

Each replaceable propeller blade 102, 103, 104 includes a blade fin 106 and a root 107. A rear cap 108 seizes the replaceable propeller blade 102, 103, 104 within the center hub 105. The assembled modular propeller 100 typically mounts on a splined shaft 110 of an outboard marine engine. A threaded portion 111 is used to fasten the whole assembly with a machine nut 112. The replaceable propeller blade 102, 103, 104 are all identical, and commercial implementations allow users to choose a variety of sizes and blade pitches. As few as two and as many as six evenly distributed blades can be used in various embodiments of the present invention. Typical applications are 8-18 inch diameter three blade propellers intended for 6-350 horsepower motors but are not limited in any way with respect to horsepower, pitch, diameter, number of blades in open or ducted configurations.

Figures 2A, 2B, 2C, 2D:
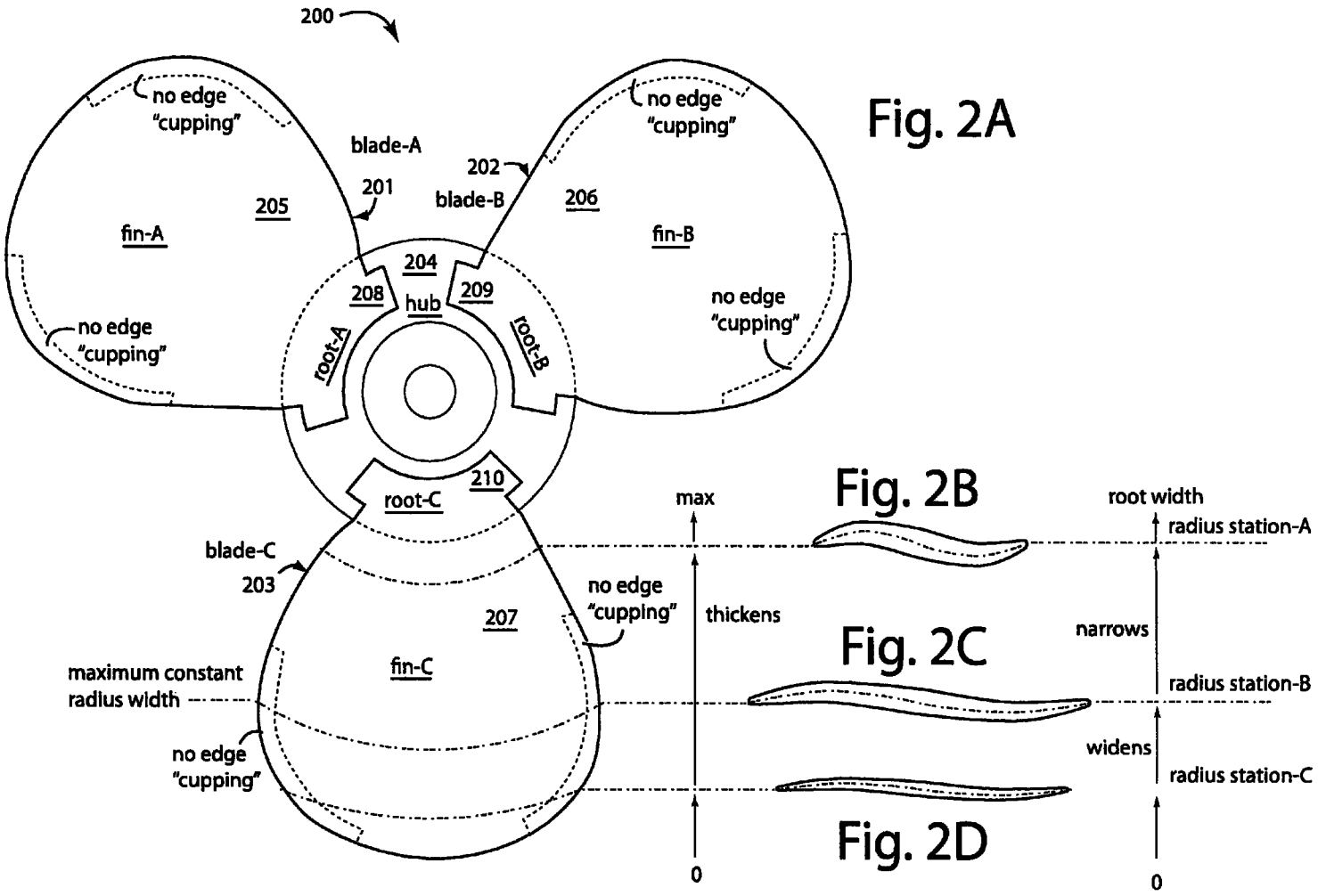
FIGS. 2A, 2B, 2C, and 2D are a rear view, a first single-blade cross-section, a second single-blade cross-section, and a third single-blade cross-section diagram of another efficient reverse-thrusting modular propeller embodiment of the present invention like that of FIG. 1.

FIGS. 2A-2D illustrate another efficient reverse-thrusting modular propeller embodiment of the present invention, referred to herein by the general reference numeral 200. Propeller 200, in this example, can be used on inboard/outboard and outboard boat motors, and comprises three interlocking replaceable propeller blades (A, B, C) 201, 202, 203 seized into identical matching slots in a center hub 204. These form a familiar three-point pedal-curve in profile as seen in FIG. 2A. Four blade versions are also commercially viable. Each propeller blade (A, B, C) 201, 202, 203, comprises a fin part 205-207 and a root part 208-210, respectively.

In non-symmetrical hydrofoils, their mean camber lines lay only to one side of the straight chord line. In symmetrical hydrofoils, the mean camber lines and the chord line are coincident. For symmetrical hydrofoils with a sinusoidal mean camber, as shown in FIGS. 2B-2D, the sinusoid zero-crossing of the chord line occurs at mid-center of the blade at all radius stations. FIGS. 2A-2D show three examples. The sinewave begins at zero amplitude at each leading edge, zero crosses at the 50% chord point, and returns to zero again at the trailing edge.

In a typical embodiment, the "wavelength" of the sinusoidal chord line is about 4.5" at the neck next to the root as in FIG. 2B, flaring out to about 6.25" as in FIG. 2C.

Each blade's many radius stations have the same basic shape, only the thickness-to-chord-ratio changes. The sinewave remains the same, albeit the blade section gets thinner progressing from the root of the blade to the tip. The sinusoidal mean camber line always completes 360-degrees of angle, from leading edge to trailing edge, along each same radius station across the width of the blade. The sinusoids individual wavelengths vary, but each still nevertheless completes 360-degrees. This holds true moving out from the root to the more distal radius stations.

The upper and lower surface equations given herein merely describe the actual coordinates of one particular section of an exemplary blade at its 75% radius station. The mean camber line equation can describe many sinewave shapes, wavelengths, and amplitudes. The amplitude is one variable chosen to fit each instance.

The upper and lower surface hydrofoil shapes can be described in general by modifying the upper and lower surface equations such that they were become a function of the thickness-to-chord-ratio, thus describing all the actual sections of the blades from their roots to their tips. Alternatively, starting with the set of equations herein that describe the 75% radius station, thickness to chord ratios of 0.20 to 0.03 can be created and superimposed on a sinusoidal mean camber line with varying wavelengths to fit the spans available.

Pitch is typically measured at 75% radius station and is constructed by passing an imaginary line through the points of the leading and trailing edges. One revolution of the propeller will theoretically move it forward the pitch amount. For example a 15-inch propeller turning one revolution in water will move 15-inches. In actual practice, no propeller is 100% efficient and such 15-inch pitch will yield something less, like 14.5-inches.

Pitch is a measure understood by end users to help them select among of similarly performing propellers. The range of pitches included in embodiments of the present invention is about 5.0 to 50.0 inches.

Figure 3A:
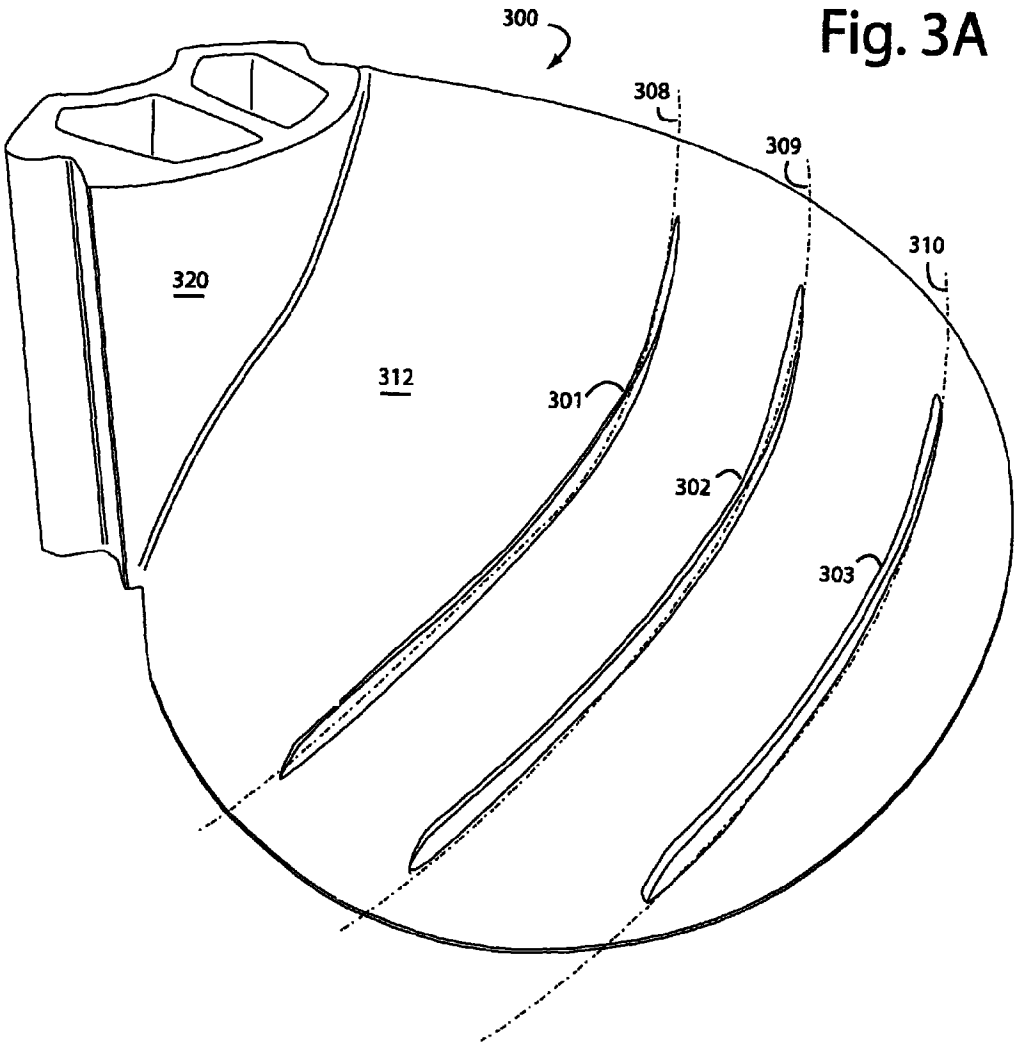
FIGS. 3A-3C are front, rear, and side perspective views of a modular replaceable propeller blade with three parallel ridges that are included on each of the front and rear surfaces, and as such this blade advances on the design of that in FIGS. 2A-2D.
Figure 3B:
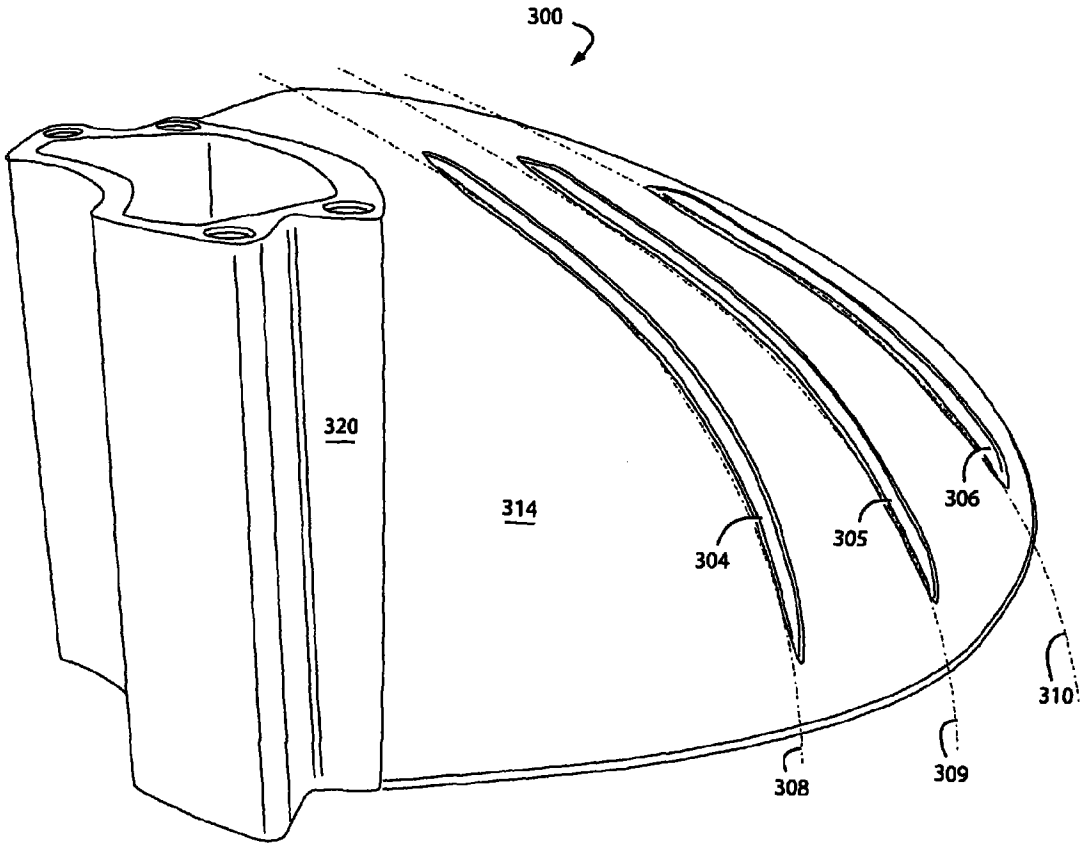
Figure 3C:
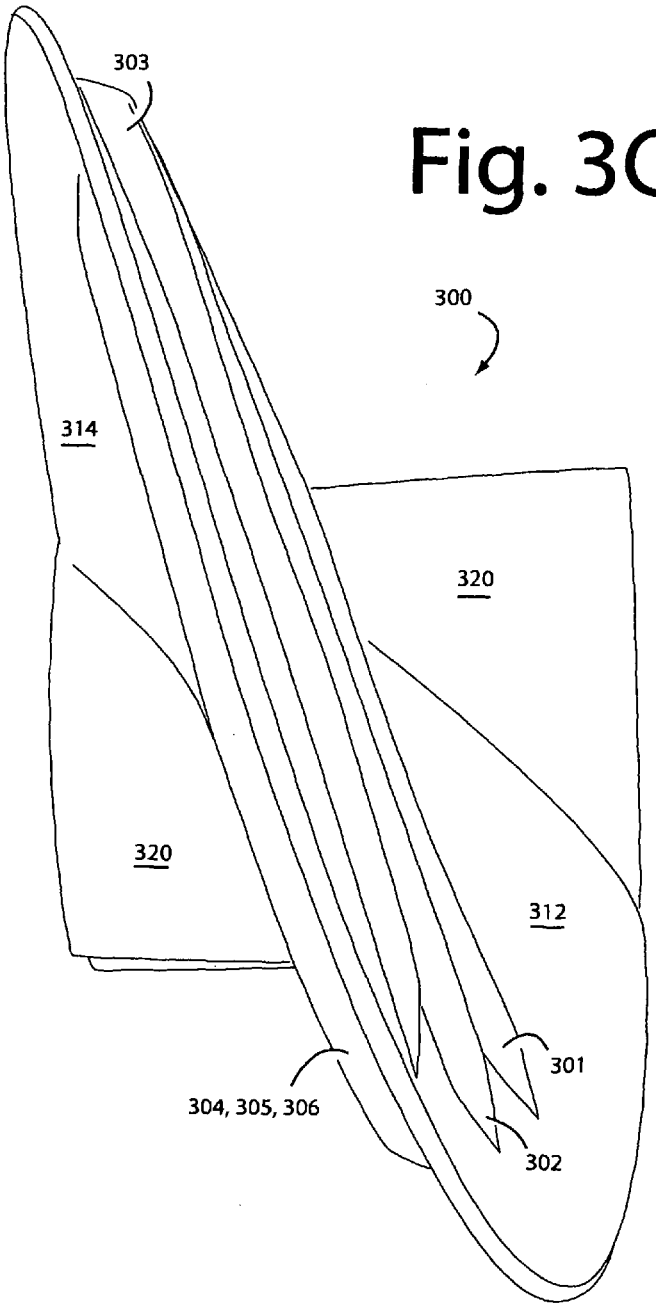

FIGS. 3A-3C show three parallel ridges that are included on each of the front and rear surfaces of a blade 300. Such blade 300 advances on the design of that in FIGS. 2A-2D. Seen variously amongst FIGS. 3A-3C, six raised ridges 301-306 are fixed in parallel on three constant radius stations 308-310 on front and rear surfaces 312 and 314. All six are molded in to form one piece. As seen in FIG. 3A, raised ridges 301-303 are disposed on surface 312. In FIG. 3B, raised ridges 304-306 are disposed on surface 314. The raised ridges 301-306 each rise a maximum of 3/16" and are typically 4" to 5" long. The three constant radius stations 308-310 are typically set 2.5", 3.0", and 3.5" away from the outer surface of a root 320, e.g., for a 15" diameter propeller assembly.

There is a group-staggering that exists between raised ridges 301-303 and raised ridges 303-306 on the opposite surface. The small curved surfaces control the water flow over the blades which enhances the performance of the entire propeller system.

A prototype of the reverse thrust blades and conventional blades for comparison were tested on the same boat. Here is what we found. A gain of one mile-per-hour (MPH) was observed in the 2000 to 3200 revolutions per minute (RPM) range as compared to Piranha HYDROBYTE™ blades. The reverse thrust blades expressed a forward top speed of 8-mph at wide-open-throttle (WOT) and revolution limiting to 3200-RPM. The stopping power was the most notable change, a full boat length (55') shorter. A basic rule for prop selection is the engine should be running within its specified RPM range at WOT. Most owner's manuals usually specify 5000-5500 RPM for an outboard, and 4200-5000 RPM for a sterndrive. If the engine is not able to do this in operation, it may be severely overworked by the propeller. A prime cause of premature engine failure. Over-revving is bad as well, it can cause severe damage. The wrong propeller will blow, ventilate, or otherwise suck air excessively when turning or accelerating. If the RPM is too high, a propeller with a longer pitch should be substituted. If the RPM is too low, a propeller with a shorter pitch should be exchanged.

A heavy houseboat was used for testing, a 2014 Sunstar™ 15' by 55' with a single engine Volvo PENTA A-200-V6 with an SX-A 1.97 gear drive, and that is used in rental service. Its original blades ventilated at 2100-RPM in reverse, and the reverse thrust held to 2500-RPM.

A Piranha Propeller was earlier tested on a 1989 Ski Pro with a 260 Mercury inboard/outboard tied to a dock with an electronic load measuring device. A standard 15×15 Piranha Propeller operated at:

1000 RPM produced 75 pounds of reverse thrust;
1500 RPM produced 125 pounds of reverse thrust;
2000 RPM produced 140-160 pounds of reverse thrust and began ventilating; and
2500 RPM produced 90-120 pounds of reverse thrust, losing to excessive ventilation.

A competing conventional 15×15 "high thrust" propeller at:

1000 RPM produced 150 pounds of reverse thrust;
1500 RPM produced 325 pounds of reverse thrust;
2000 RPM produced 480 pounds of reverse thrust and began ventilating; and
2500 RPM produced 480-500 pounds of reverse thrust, losing to excessive ventilation.

A Piranha 15×15 propeller (in an embodiment of the present invention) running at:

1000 RPM produced 160 pounds of reverse thrust;
1500 RPM produced 395 pounds of reverse thrust;
2000 RPM produced 550 pounds of reverse thrust and began ventilating; and
2500 RPM produced 650 pounds of reverse thrust, losing a little to a hint of ventilation.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A method for balancing the forward and reverse thrust of a water propeller turning in its forward and reverse directions, comprising:

providing a hydrofoil with a thickness;

profiling a hydrofoil that is symmetrical about a sinusoidal mean camber line of 360° in each of several constant-radius cross-sections;

decreasing the thickness of the hydrofoil from an attachment root to zero at a distal end, wherein, the mean camber lines of the hydrofoil shape remain the same from the root to the distal end as the thickness diminishes;

restricting the symmetrical hydrofoil from a minimum of 3% thickness-to chord-ratio to a maximum of 20% thickness-to-chord-ratio providing the hydrofoil with a radius station and upper and lower surface contours; and adjusting the 75% radius station of the hydrofoil to have a thickness-to-chord-ratio of 8%, wherein the thickness of the hydrofoil is 8% of its chord length, and such that the upper and lower surface contours can be expressed mathematically for an upper surface by: $Y=0.575x^3-0.966x^2+0.393x+0.008$; and, for a lower surface by: $Y=0.575x^3-0.759x^2+0.185x-0.010$; and for a mean camber line: $Y=A\sin x$, where $0.02\leq A\leq 0.08$; and eliminating any localized cupping on any leading or trailing edges of the hydrofoil.

2. The method of claim 1, further comprising:

disposing a number of parallel raised ridges that follow constant radius lines equally on both sides of the hydrofoil.

3. A water propeller blade with a root attachment for a hub, and a symmetrical fin in one piece, comprising:

a fin shaped to be a radially symmetrical hydrofoil about a sinusoidal mean camber line at essentially every constant radius station, and laterally symmetrical edge to edge;

a pitch in the range of 5.0 to 50.0 inches;

a thickness-to-chord ratio of the fin at any radius station in the range of 3% minimum to a maximum of 20%;

upper and lower surface contours which can be expressed mathematically for an upper surface by: $Y=0.575x^3-0.966x^2+0.393x+0.008$; and, for a lower surface by: $Y=0.575x^3-0.759x^2+0.185x-0.010$; and for a mean camber line: $Y=A\sin x$, where $0.02\leq A\leq 0.08$; and a root to which the fin is integrated into one piece.

4. The water propeller blade of claim 3, further comprising:

a plurality of ridges equally disposed on opposite surfaces of the fin in parallel to one another and along matching constant radius stations.

5. The water propeller blade of claim 4, further comprising:

a set of three ridges equally disposed on opposite surfaces of the fin and on each opposite surface in parallel to one another and along matching constant radius stations separated by half an inch.

6. The water propeller blade of claim 4, further comprising:

a set of ridges equally disposed on opposite surfaces of the fin and on each opposite surface in parallel to one another and separated along matching constant radius stations and staggered between said opposite surfaces.

7. A water propeller assembly, comprising:

a hub having attachments for a boat motor and a number of slots to receive and seize replaceable blades;

a set of identical replaceable blades each with a root attachment for the hub, and a symmetrical fin in one piece;

a fin included in each replaceable blade and shaped to be a radially symmetrical hydrofoil about a sinusoidal mean camber line at essentially every constant radius station, and laterally symmetrical edge to edge;

a pitch in the range of 5.0 to 50.0 inches;

a thickness-to-chord ratio at any radius station in the range of 3% minimum to a maximum of 20%;

upper and lower surface contours which can be expressed mathematically for an upper surface by: $Y=0.575x^3-0.966x^2+0.393x+0.008$; and, for a lower surface by: $Y=0.575x^3-0.759x^2+0.185x-0.010$; and for a mean camber line: $Y=A\sin x$, where $0.02\leq A\leq 0.08$; and a root to which the fin is integrated into one piece.

8. The water propeller assembly of claim 7, further comprising:

a plurality of ridges included in each replaceable blade that are equally disposed on opposite surfaces of the fin in parallel to one another and along matching constant radius stations.

9. The water propeller assembly of claim 7, further comprising:

a set of three ridges included in each replaceable blade that are equally disposed on opposite surfaces of the fin and on each opposite surface in parallel to one another and along matching constant radius stations separated by half an inch.

10. The water propeller assembly of claim 7, further comprising:

a set of ridges included in each replaceable blade that are equally disposed on opposite surfaces of the fin and on each opposite surface in parallel to one another and separated along matching constant radius stations and staggered between said opposite surfaces.

11. An improved, efficient reverse-thrusting modular propeller including a plurality of identical and replaceable propeller blades assembled into a center hub and seized by a retaining cap, the improvement comprising:

a fin attached to a root in one piece, wherein:

the fin is profiled as a hydrofoil that in constant-radius cross-section is symmetrical about a sinusoidal camber line of 360°;

the thickness of the fin decreases from an attachment at the root to zero at a distal end of the blade;

the width of the fin increases to a maximum from said attachment at the root and then decreases to zero at said distal end of the blade, and generally profiled as a pedal curve; and upper and lower surface contours which can be expressed mathematically for an upper surface by: $Y=0.575\ x^3-0.966\ x^2+0.393\ x+0.008$; and, for a lower surface by: $Y=0.575\ x^3-0.759\ x^2+0.185\ x-0.010$; and for a mean camber line: $Y=A \sin x$, where $0.02 \leq A \leq 0.08$.

* * * * *